US007644964B2

(12) United States Patent
Bushey et al.

(10) Patent No.: US 7,644,964 B2
(45) Date of Patent: Jan. 12, 2010

(54) DOOR WEDGE INCORPORATING HOOK

(76) Inventors: Richard D. Bushey, 1596 38th Ave., Kenosha, WI (US) 53144; Bret L. Bushey, 5535 Sandhill Rd., Caledonia, WI (US) 53402

( * ) Notice: Subject to any disclaimer, the term of this patent is extended or adjusted under 35 U.S.C. 154(b) by 0 days.

(21) Appl. No.: 11/864,082

(22) Filed: Sep. 28, 2007

(65) Prior Publication Data

US 2008/0079269 A1 Apr. 3, 2008

Related U.S. Application Data

(60) Provisional application No. 60/847,709, filed on Sep. 28, 2006.

(51) Int. Cl.
*E05C 17/44* (2006.01)
*E05C 17/54* (2006.01)

(52) U.S. Cl. ..... 292/342; 292/288; 292/343; 292/DIG. 15; 292/DIG. 38; 16/82; 16/86 R; D8/402

(58) Field of Classification Search ..... 292/288, 292/342, 343, DIG. 15, DIG. 38; 16/82, 16/86 R; D8/402
See application file for complete search history.

(56) References Cited

U.S. PATENT DOCUMENTS

| | | | | | |
|---|---|---|---|---|---|
| 88,907 | A | | 8/1869 | Reynolds | |
| 165,984 | A | | 7/1875 | Cosbey | |
| 171,807 | A | * | 1/1876 | Hoffman | 292/343 |
| 232,710 | A | * | 9/1880 | Hartley | 292/342 |
| 466,104 | A | | 12/1891 | Naegele | |
| 652,659 | A | * | 6/1900 | Blackwell | 292/343 |
| 701,431 | A | * | 6/1902 | Watts | 292/343 |
| 804,585 | A | * | 11/1905 | Depue | 292/343 |
| 1,351,453 | A | * | 8/1920 | Wells, Jr | 292/343 |
| 1,354,046 | A | | 9/1920 | Lanning | |
| 1,448,250 | A | | 3/1923 | Au-Miller | |
| 1,599,595 | A | * | 9/1926 | Sponsel | 292/343 |
| 1,879,664 | A | * | 9/1932 | Eaton | 292/343 |
| 2,376,117 | A | | 5/1945 | Bright et al. | |
| 2,703,728 | A | * | 3/1955 | Raber | 292/288 |
| 2,898,140 | A | | 8/1959 | Gislason | |
| 3,328,065 | A | * | 6/1967 | Arenson | 292/343 |
| 3,684,233 | A | | 8/1972 | Vukich | |
| 4,044,424 | A | * | 8/1977 | Sasgen | 16/85 |
| D284,738 | S | * | 7/1986 | Stone | D8/402 |
| 4,688,761 | A | * | 8/1987 | Wilcox | 254/104 |

(Continued)

FOREIGN PATENT DOCUMENTS

| | | | |
|---|---|---|---|
| GB | 2212213 | A * | 7/1989 |

(Continued)

*Primary Examiner*—Carlos Lugo
(74) *Attorney, Agent, or Firm*—Boyle Fredrickson, S.C.

(57) ABSTRACT

A door wedge is provided for maintaining a door at a user-desired position. The door wedge includes a base extending along a first axis. The base has upper and lower surfaces and first and second ends. An inclined plate extends along a second axis at a predetermined angle to the first axis. The inclined plate has upper and lower surfaces and first and second ends. The first end of the inclined plate intersects the first end of the base. A hook projects from the inclined plate. The hook has a terminal end vertically spaced from the upper surface of the inclined plate. A pad is affixed to the lower surface of the base.

16 Claims, 7 Drawing Sheets

U.S. PATENT DOCUMENTS

| | | | | | |
|---|---|---|---|---|---|
| 4,831,688 | A | * | 5/1989 | Deininger | 16/319 |
| 5,011,203 | A | | 4/1991 | Tackett | |
| 5,217,269 | A | * | 6/1993 | Wiltberger | 292/343 |
| 5,368,349 | A | * | 11/1994 | Hebert et al. | 292/343 |
| RE34,889 | E | * | 4/1995 | Fogarty et al. | 14/69.5 |
| 5,711,557 | A | * | 1/1998 | Nicolosi | 292/288 |
| 5,711,560 | A | * | 1/1998 | Gilbertson | 292/343 |
| D410,380 | S | | 6/1999 | Towns | |
| 6,135,516 | A | * | 10/2000 | Gasperino | 292/343 |
| 6,161,252 | A | * | 12/2000 | Rodriguez | 16/82 |
| 6,616,128 | B2 | | 9/2003 | Selzer | |
| D481,625 | S | * | 11/2003 | Ellsworth | D8/402 |
| 6,966,100 | B2 | * | 11/2005 | Sonne | 16/110.1 |
| 7,014,229 | B1 | * | 3/2006 | Stelmach | 292/342 |
| D563,744 | S | * | 3/2008 | Adwar | D8/47 |
| 2005/0225100 | A1 | * | 10/2005 | Pendergrass | 292/343 |

FOREIGN PATENT DOCUMENTS

| | | |
|---|---|---|
| JP | 11-125052 | 5/1999 |
| JP | 2002-327567 | 11/2002 |

* cited by examiner

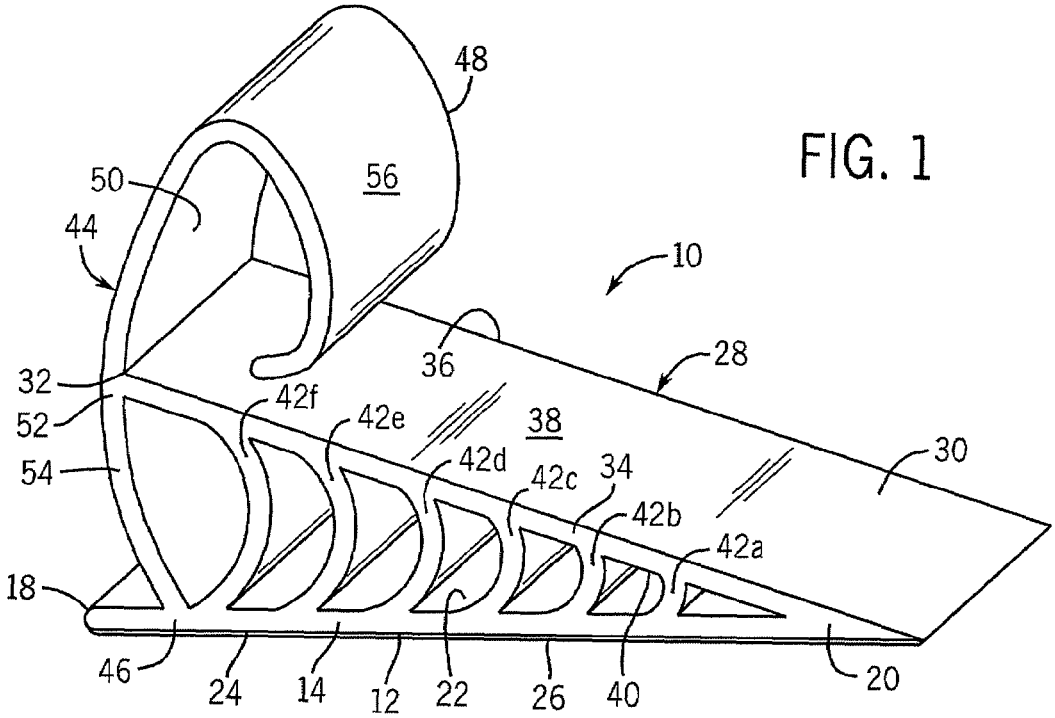
FIG. 1
FIG. 2
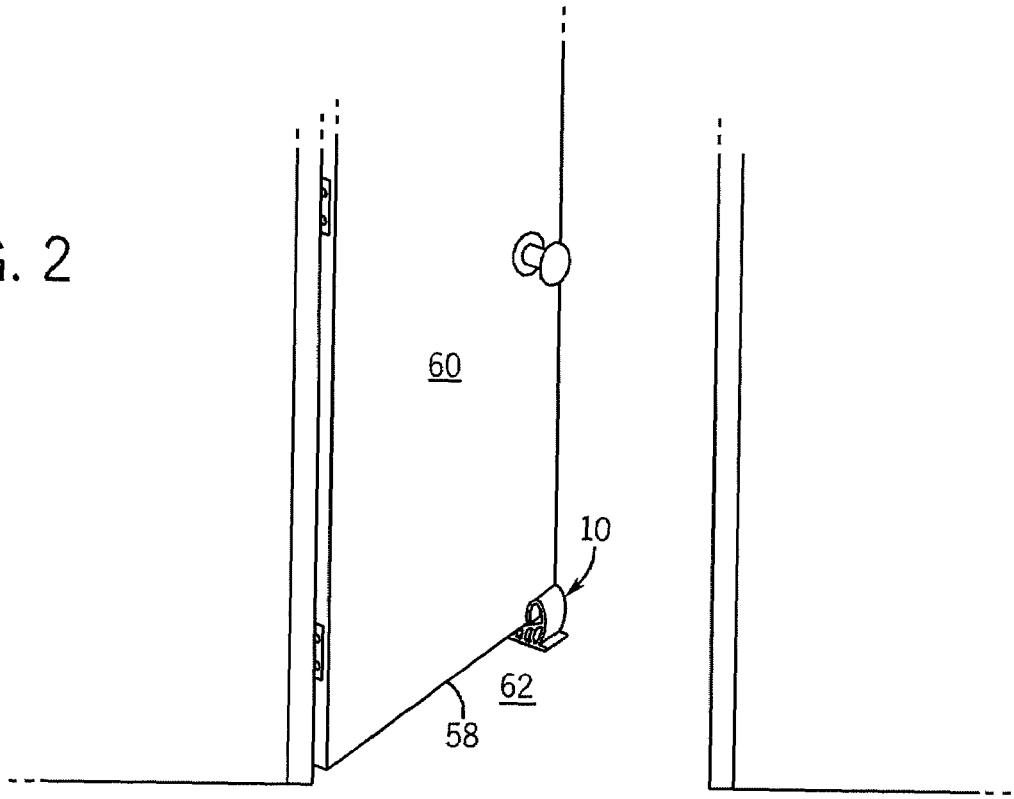

DOOR WEDGE INCORPORATING HOOK

CROSS-REFERENCE TO RELATED APPLICATIONS

This application claims the benefit of U.S. Provisional Application Ser. No. 60/847,709, filed Sep. 28, 2006.

FIELD OF THE INVENTION

This invention relates generally to door stops, and in particular, to a door wedge that may be positioned between the bottom edge of a conventional door and a supporting surface above which the door pivots in order to maintain the door at a user desired location.

BACKGROUND AND SUMMARY OF THE INVENTION

As is known, various types of door props, door stops or door wedges have been developed to prevent a door from being opened or to maintain an open door at a user desired location. By way of example, Hoffman, U.S. Pat. No. 171,807 discloses a door-check for holding a door ajar. The door-check is formed from a rubber wedge having an upper, inclined surface. The inclined surface has a plurality of transverse ridges or waves formed therein. The base of the door-check is roughened or toothed. In operation, the lower surface of the door is pivoted over the inclined surface of the door-check and pressed over the crest or ridges of the waves in the inclined surface until such point as the bottom surface of the door engages a crest of sufficient height to arrest it. The roughened base of the door check prevents any tendency of the door-check to slip over a carpet.

While the door-check disclosed in the Hoffman '807 is functional for its intended purpose, the inclined surface of the door check disclosed therein has insufficient resiliency to catch and hold the door in the user desired location. Consequently, the door, intended to be held in the user desired position, may inadvertently become disengaged from the door-check, thereby freeing the door to once again pivot above the supporting surface.

Further, it has been found that these prior door stops and wedges have a tendency to become lost when being stored or transported. For example, cleaning crews utilize door wedges throughout a building during cleanup. Consequently, these door wedges must be transported by the cleaning crew to doors in different parts of the building or to different job sites during performance of their tasks. Inevitably, a number of the door wedges used by the cleaning crew can become misplaced. As a result, these door wedges must be replaced, thereby increasing the overall costs associated with cleaning the buildings.

In order to overcome the limitations disclosed in the Hoffman '807 patent, various means for anchoring a door in a set position have been considered. By way of example, Raber, U.S. Pat. No. 2,703,728 discloses a device expressly specifically for retaining a horizontal swingable door in a set position by anchoring the lower edge portion of a door to a conventional horizontal floor surface. The device includes a plate designed to underlie the lower surface of a conventional door. The plate includes shoulders that form blocks on opposite ends thereof and a leaf spring situated between the blocks. By exerting pressure on the leaf spring, the plate is urged into engagement with the bottom surface of the door so as to effectively fasten the device to the door and anchor the door to the supporting surface. Once again, while the Raber '728 patent is functional for its intended purpose, the device is somewhat complicated due to the numerous component parts. Further, due to the number of parts provided, the cost of the anchoring device disclosed in the Raber '728 patent is prohibitive.

Therefore, it is a primary object and feature of the present invention to provide a door wedge for retaining a door at a user desired selected location that is simple to utilize and inexpensive to manufacture.

It is a further object and feature of the present invention to provide a door wedge for retaining a door at a user selected location that may be utilized without damaging the door or the supporting surface above which the door pivots.

It is a still further object and feature of the present invention to provide a door wedge for retaining a door in a user selected position that accommodates variances in the spacing between the bottom of the door and the supporting surface above which the door pivots.

It is a still further object and feature of the present invention to provide a door wedge for retaining a door in a user selected position that incorporates a hook for supporting the door wedge during storage and transport.

It is a still further object and feature of the present invention to provide a door wedge for retaining a door in a user selected position that incorporates a stop limiting movement of the door onto the door wedge.

In accordance with the present invention, a door wedge is provided for maintaining a door at a user desired position. The door is pivotable over a supporting surface between an open position and a closed position. The door wedge includes a body extending along a longitudinal axis and having a resilient inclined surface for engaging a bottom surface of the door and a lower surface at an acute angle to the inclined surface. A hook projects from the body and a pad is affixed to the lower surface of the body for discouraging movement of the body over the supporting surface.

The hook extends from the inclined surface and the body is fabricated from a vinyl material. The body includes an inclined plate having a lower surface and an upper surface defining the inclined surface of the body. The body also includes a base having an upper surface and a lower surface defining the lower surface of the body. A plurality of generally arcuate ribs have upper ends in engagement with the lower surface of the inclined plate and lower ends in engagement with the upper surface of the base. The arcuate ribs are generally C-shaped.

The inclined plate has first and second ends, and the base has first and second ends. The first end of the base intersects the first end of the inclined plate. An end wall has a first end interconnected to the second end of inclined plate and a second end operatively connected to the upper surface of the base. The hook is positioned between the first and second ends of the inclined plate and includes a terminal end vertically spaced from the upper surface of the inclined plate. The lower surface of the body includes first and second spaces slots transverse to the longitudinal axis. The pad includes a first end received in the first slot in the lower surface of the body and a second end received in the second slot in the lower surface of the body.

In accordance with a further aspect of the present invention, a door wedge is provided for maintaining a door at a user desired position. The door is pivotable over a supporting surface between an open position and a closed position. The door wedge includes a base extending along a first axis and has upper and lower surfaces and first and second ends. An inclined plate extends along a second axis at a predetermined angle to the first axis and has upper and lower surfaces and first and second ends. The first end of the inclined plate intersects the first end of the base. A hook projects from the inclined plate. The hook has a terminal end vertically spaced from the upper surface of the inclined plate. A pad is affixed to the lower surface of the base.

A plurality of generally arcuate ribs has upper ends in engagement with the lower surface of the inclined plate and lower ends in engagement with the upper surface of the base. The arcuate ribs are generally C-shaped. An end wall has a first end interconnected to the second end of inclined plate and a second end operatively connected to the upper surface of the base. The hook includes an central portion overlapping the upper surface of the inclined plate. The lower surface of the base includes first and second spaces slots transverse to the longitudinal axis. The pad includes a first end received in the first slot in the lower surface of the base and a second end received in the second slot in the lower surface of the base.

In accordance with a still further aspect of the present invention, a door wedge is provided for maintaining a door at a user desired position. The door is pivotable over a supporting surface between an open position and a closed position. The door wedge includes a base extending along a first axis and having first and second ends. An inclined plate extends along a second axis at a predetermined angle to the first axis and has first and second ends. The first end of the inclined plate intersects the first end of the base. A hook projects from the inclined plate. The hook has a terminal end vertically spaced from the inclined plate.

The inclined plate has a lower surface and an upper surface engageable with a bottom surface of the door. The base has an upper surface and a lower surface. A plurality of generally arcuate ribs have upper ends in engagement with the lower surface of the inclined plate and lower ends in engagement with the upper surface of the base. The arcuate ribs are generally C-shaped. An end wall has a first end interconnected to the second end of inclined plate and a second end operatively connected to the upper surface of the base. The lower surface of the base includes first and second spaces slots transverse to the longitudinal axis. The pad includes a first end received in the first slot in the lower surface of the base and a second end received in the second slot in the lower surface of the base.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 1 is an isometric view of a first embodiment of a door wedge in accordance with the present invention;

FIG. 2 is an enlarged isometric view showing the first embodiment of the door wedge of the present invention positioned beneath the bottom of a conventional door;

DETAILED DESCRIPTION OF THE DRAWINGS

Figure 3:
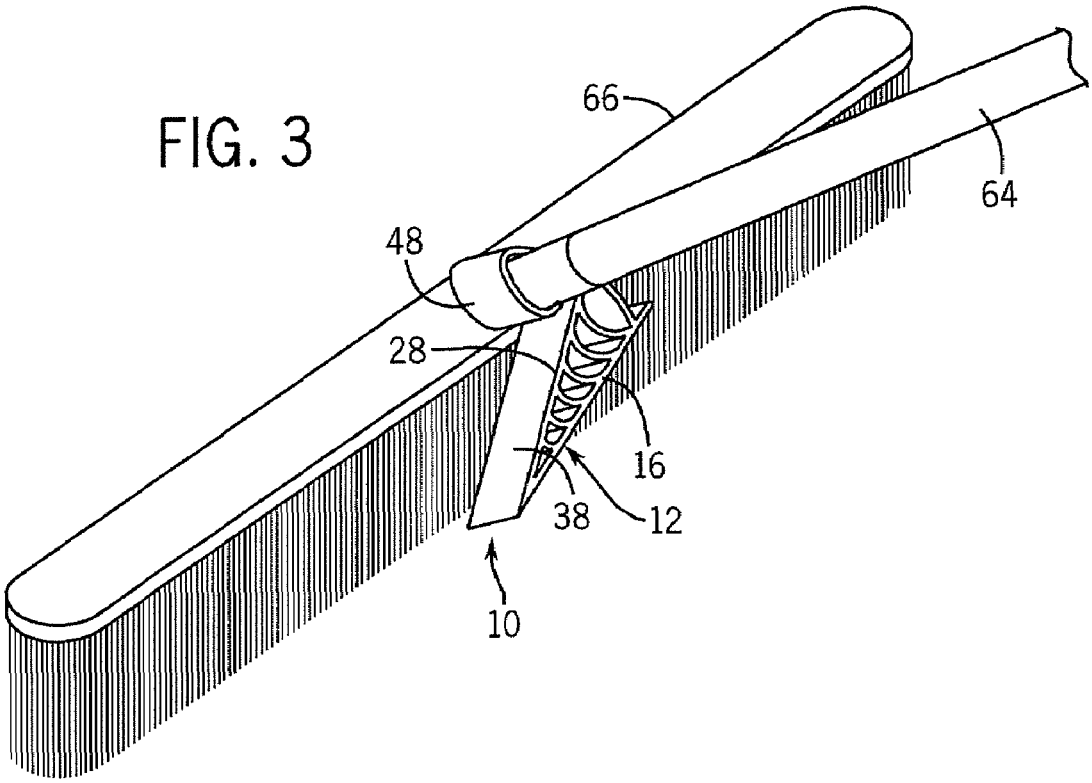
FIG. 3 is an isometric view showing the door wedge of FIG. 1 mounted on a handle of a conventional broom.
Figure 4:
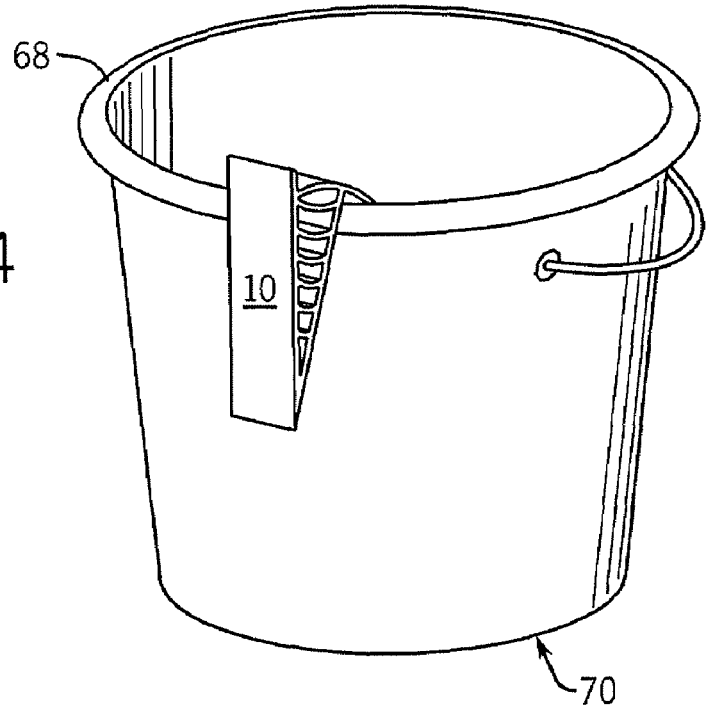
FIG. 4 is an isometric view showing the door wedge of FIG. 1 mounted on a rim of a conventional bucket
Figure 5:
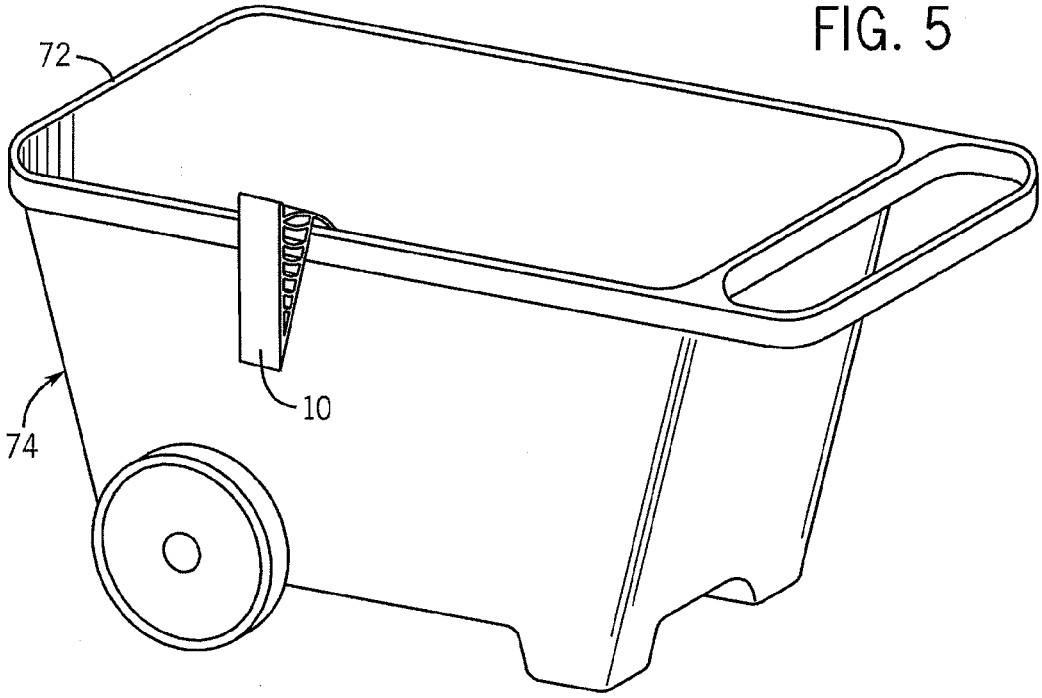
FIG. 5 is an isometric view showing the door wedge of FIG. 1 mounted on an edge of a conventional cart.
Figure 6:
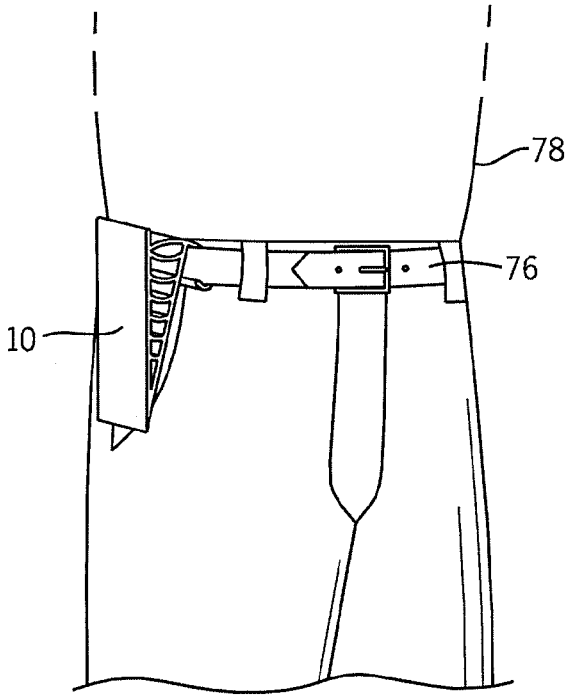
FIG. 6 is an isometric view showing the door wedge of FIG. 1 mounted on a belt of an individual.

Referring to FIGS. 1-6, a door wedge in accordance with the present invention is generally designated by the reference numeral 10. It is contemplated to fabricate door wedge 10 from a vinyl material. However, other materials are possible with deviating from the scope of the present invention. Door wedge 10 includes a generally flat base 12 extending along a longitudinal axis and having first and second sides 14 and 16, respectively, and first and second ends 18 and 20, respectively. Base 12 further includes a generally flat upper surface 22 and a generally flat lower surface 24. A generally flat skid resistant pad 26 is affixed to lower surface 24 of base 12 along the entire length thereof between first and second sides 14 and 16, respectively, and first and second ends 18 and 20, respectively. It can be appreciated that base 12 may be fabricated from a rigid material or include a rigid support molded therein. It is also contemplated for base 12 to be formed from a material having a higher durometer value that the material from which the remaining portions of door wedge 10, hereinafter described.

Door wedge 10 further includes generally inclined plate 28 extending along an axis at a predetermined acute angle to base 12. Inclined plate 28 includes first and second ends 30 and 32, respectively, and first and second sides 34 and 36, respectively. Inclined plate 28 is further defined by a generally flat upper surface 38 and a lower surface 40 directed towards upper surface 22 of base 12. First end 30 of inclined plate 28 is integral with and operatively connected to second end 20 of base 12. In addition, lower surface 40 of inclined plate 28 is operatively connected to upper surface 22 of base 12 by a plurality of longitudinally spaced C-shaped ribs **42*a*-42*f*. Rib 42*a* is spaced from first end 30 of inclined plate 28 and rib 42*f* is spaced from second end 32 of inclined plate 28. The upper ends of ribs 42*a*-42*f* are integral with and operatively connected to lower surface 40 of inclined plate 28. The lower ends of ribs 42*a*-42*f* are integral with and operatively connected to upper surface 22 of base 12. Ribs 42*a*-42*f* urge inclined plate 28 away from base 12 towards its inclined position, FIG. 1**.

Door wedge 10 further includes hook element 44 having a first lower end 46 integral with and operatively connected to base 12 at a location adjacent first end 18 thereof and a second hooked end 48. Second end 32 of inclined plate 28 intersects and is operatively connected to inner surface 50 of hook element 44 at location 52 between the lower end 46 and hooked end 48. Lower portion 54 of hook element 44 also urges inclined plate 28 away from base 12 towards its inclined position, FIG. 1. Hooked end 48 of hook element 44 folds back onto itself such that outer surface 56 of hooked end 48 is directed towards first end 30 of inclined plate 28. It is noted that hooked end 48 of hook element 44 acts as a stop and a spring, as hereinafter described.

In operation, it is intended for door wedge 10 to be positioned between lower edge 58 of a conventional door 60 and a supporting surface such as floor 62 or the like. Door wedge 10 is slid axially beneath door 60 such that upper surface 38 of inclined plate 28 engages lower edge 58 of door 60. In order to retain door 60 on door wedge 10, door 60 may be further pivoted onto upper surface 38 of inclined plate 28 towards second end 32 thereof. Under the compressive force of lower edge 48 of door 60, inclined plate 28 is urged downwardly toward upper surface 22 of base 12. Ribs 42*a*-42*f* and lower portion 54 of hook element 44 act as springs act to urge inclined plate 28 upwardly to snuggly retain door wedge 10 against lower edge 58 of door 60 thereby retaining door 60 at a user desired position. Pad 26 prevents door wedge 10 for moving along supporting surface 62 as door 60 is positioned thereon. In addition, hooked end 48 of hook element 44 limits the position of door 60 on door wedge 10 by urging door 60 away from second end 32 of inclined plate 28.

Hooked end 48 of hook element 44 of door wedge 10 allows door wedge 10 to be operatively connected to various items for storage and/or transport. By way of example, hooked end 48 of hook element 44 of door wedge 10 may be mounted on handle 64 of a conventional broom 66, FIG. 3; on rim 68 of a conventional bucket 70, FIG. 4; on outer edge 72 of a conventional cart 74, FIG. 5; and/or on belt 76 worn by an individual 78, FIG. 6.

Figure 7:
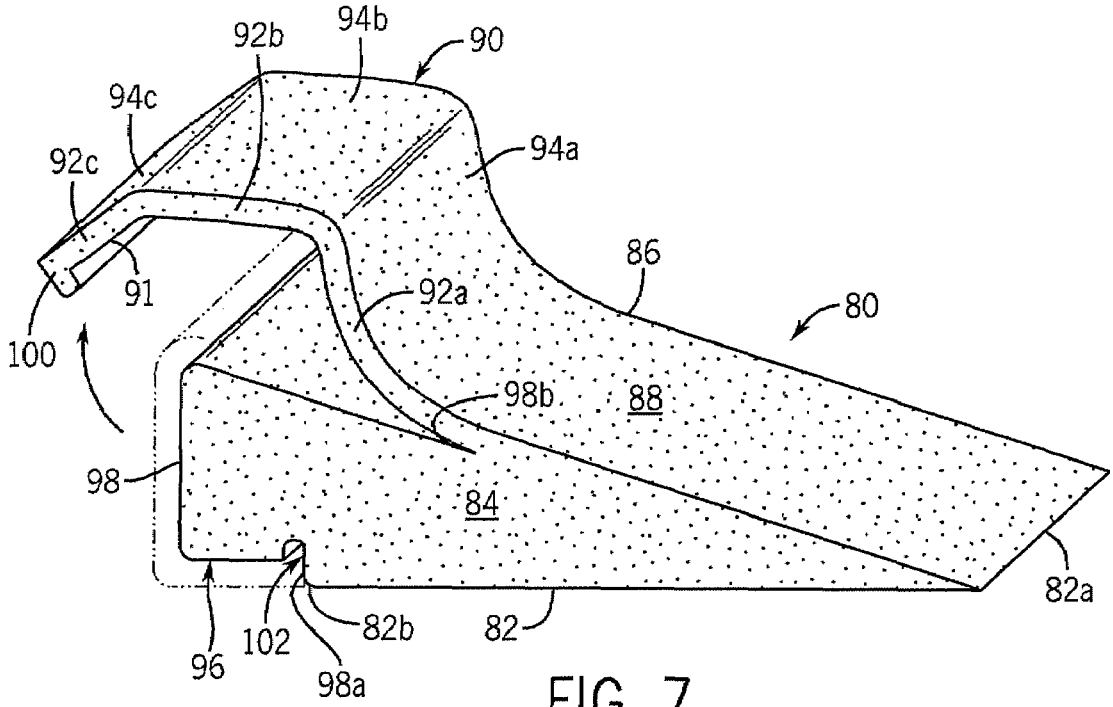
FIG. 7 is an isometric view of a second embodiment of a door wedge in accordance with the present invention with a hooked portion in an extended position.
Figure 8:
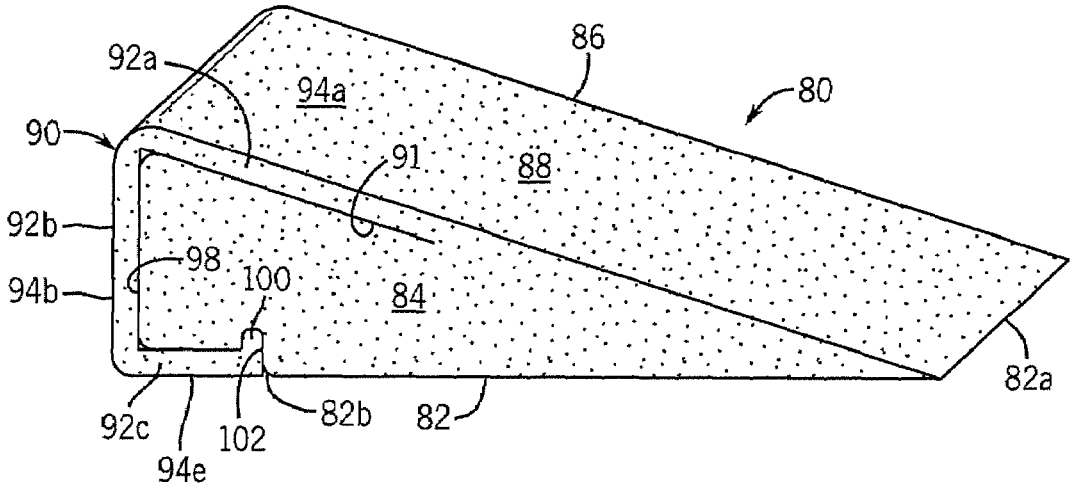
FIG. 8 is an isometric view of the second embodiment of the door wedge in accordance with the present invention with the hooked portion in a retracted position.

Referring to FIGS. 7 and 8, a still further embodiment of a door wedge in accordance with the present invention is generally designated by the reference numeral 80. Door wedge 80 is fabricated from a closed cell dense foam that provides soft gripping and holding of door 60. Door wedge 80 includes a generally flat bottom surface 82 having first and second ends 82*a* and 82*b*, respectively, first and second sides 84 and 86, respectively, and inclined surface 88. Inclined surface 88 extends from first end 82*a* of bottom surface 88 and diverges from bottom surface 82. Rear member 96 projects from second end 82*b* of bottom surface 82 and defines inner surface 98. Inner surface 98 includes a first end 98*a* that intersects second end 82*b* of bottom surface 82 and a second end that intersects hooked element 90.

Hooked element 90 includes base portion 92*a*, intermediate portion 92*b* and end portion 92*c* having corresponding outer surfaces 94*a*-94*c*, respectively. Hooked element 90 further includes inner surface 91 engageable with inner surface 98 of rear member 98. End portion 92*c* of hooked element 90 terminates at an enlarged head 100 that is receivable within recess 102 formed in first end 98*a* of inner surface 98 with door wedge 80 in its retracted position, FIG. 8. In addition, with door wedge 80 in its retracted position, FIG. 8, outer surface 94*a* of base portion 92 is coplanar with inclined surface 88 and outer surface 94*c* of end portion 92*c* is coplanar with bottom surface 82. With door wedge 90 in its extended position, FIG. 7, head 100 of end portion 92*c* of hooked element 90 is removed from recess 102 formed in first end 98*a* of inner surface 98, thereby allowing door wedge 90 to be operatively connected to various items for storage and/or transport.

Figure 9:
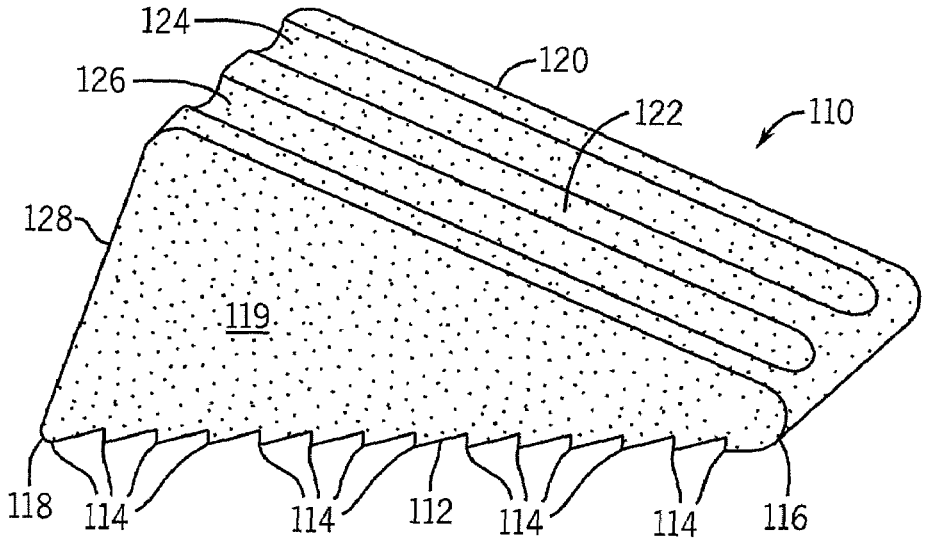
FIG. 9 is an isometric view of a third embodiment of a door wedge in accordance with the present invention.

Referring to a FIG. 9, a still further embodiment of a door wedge in accordance with the present invention is generally designated by the reference numeral 110. Door wedge 110 is fabricated from a closed cell dense foam that provides the soft gripping and holding of door 60. Door wedge 110 includes a serrated bottom surface 112 defining a plurality of teeth 114 projecting therefrom. Bottom surface 112 includes first and second ends 116 and 118, respectively, and extends between first and second sides 119 and 120, respectively. Inclined surface 122 extends along a longitudinal axis from first end 116 of bottom surface 112 and diverges from bottom surface 112. First and second generally parallel grooves 124 and 126, respectively, are provided in inclined surface 122. Inclined surface 122, second end 118 of bottom surface 112, and first and second sides 119 and 120, respectively, are interconnected by end surface 128.

In operation, it is intended for door wedge 110 to be positioned between lower edge 58 of a conventional door 60 and supporting surface 62. Door wedge 110 is slid axially beneath door 60 such that inclined surface 122 of door wedge 110 engages lower edge 58 of door 60. In order to retain door 60 on door wedge 110, door 60 may be further pivoted onto inclined surface 122 such that the force of lower edge 48 of door 60 compresses inclined surface 122. Teeth 114 on bottom surface 112 prevent door wedge 110 for moving along supporting surface 62 as door 60 is positioned thereon.

Figure 10:
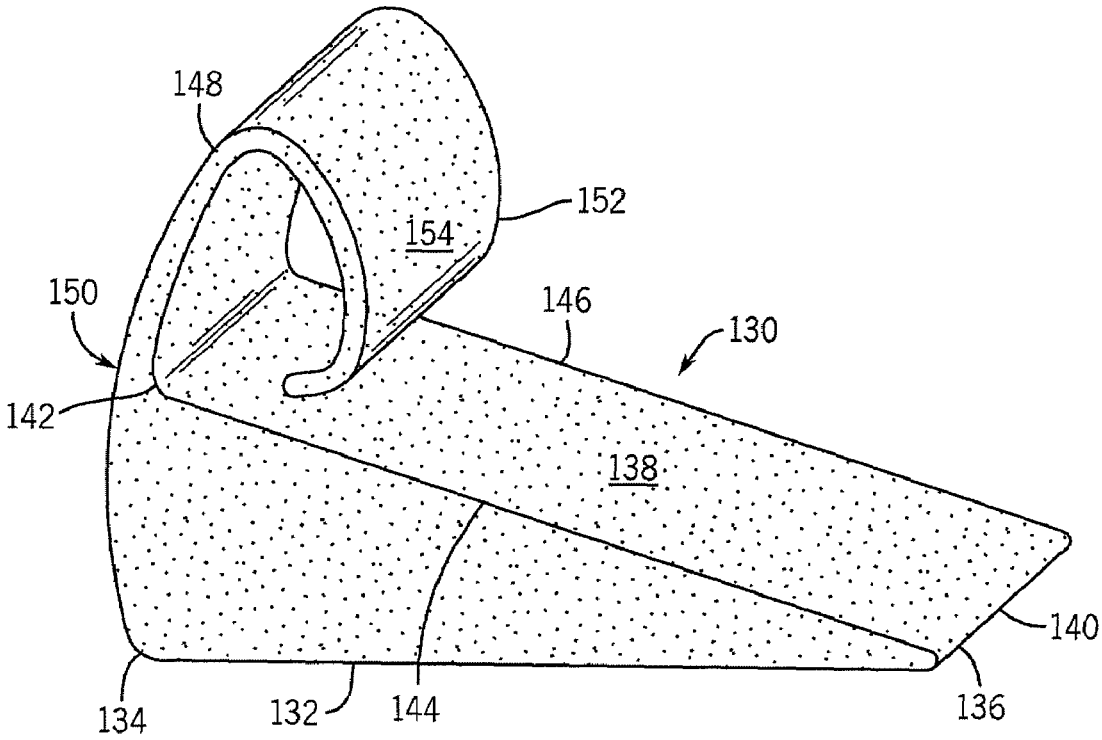
FIG. 10 is an isometric view of a fourth embodiment of a door wedge in accordance with the present invention.

Referring to FIG. 10, a still further embodiment of a door wedge in accordance with the present invention is generally designated by the reference numeral 130. Door wedge 130 is fabricated from a closed cell dense foam that provides the soft gripping and holding of door 60. Door wedge 130 includes a generally flat bottom surface 132 extending along a longitudinal axis and having first and second sides, respectively, and first and second ends 134 and 136, respectively. Door wedge 130 further includes generally inclined surface 138 having first and second ends 140 and 142, respectively, and first and second sides 144 and 146, respectively. First end 140 of inclined surface 138 is integral with and operatively connected to second end 136 of bottom surface 132.

Door wedge 130 further includes hook element 148 having a first lower end 150 integral with and extending from second end 142 of inclined surface 138 and a second hooked end 152. Second hooked end 152 of hook element 148 is spaced from inclined surface 138 and includes an outer surface 154 directed towards first end 140 of inclined surface 138. It is noted that hook element 148 acts as a stop and a spring, as hereinafter described.

In operation, it is intended for door wedge 130 to be positioned between lower edge 58 of a conventional door 60 and supporting surface 62. Door wedge 130 is slid axially beneath door 60 such that inclined surface 138 engages lower edge 58 of door 60. In order to retain door 60 on door wedge 130, door 60 may be further pivoted onto inclined surface 138 towards second end 142 thereof such that the force of lower edge 48 of door 60 compresses inclined surface 138. Hook element 148 acts as a spring to limit the position of door 60 on door wedge 130 by urging door 60 away from second end 142 of inclined surface 138.

Figure 11:
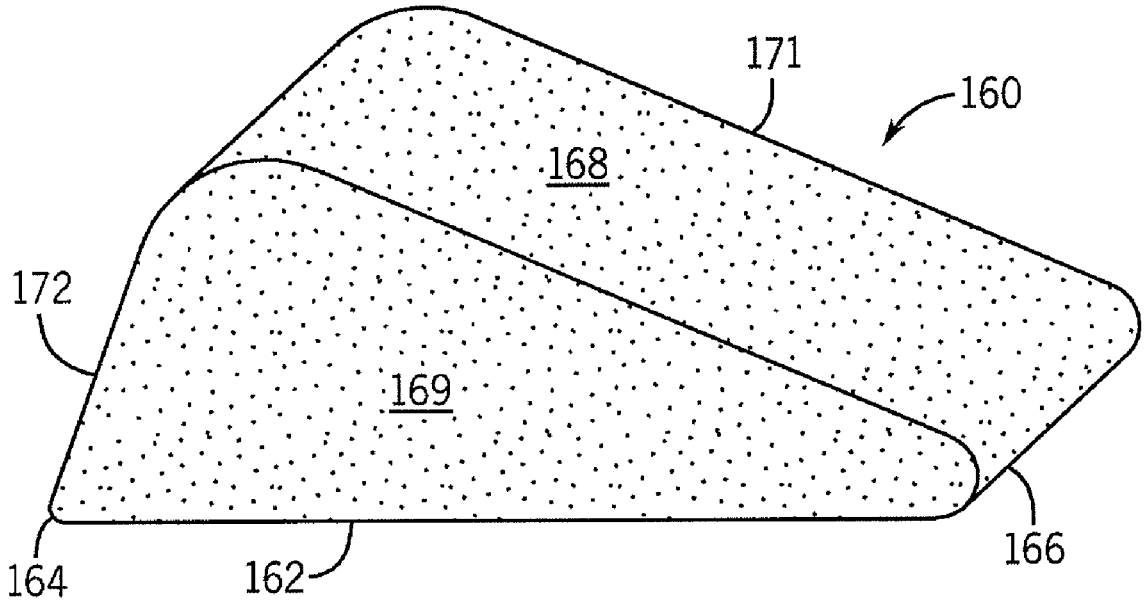
FIG. 11 is an isometric view of a fifth embodiment of a door wedge in accordance with the present invention.

Referring to a FIG. 11, a still further embodiment of a door wedge in accordance with the present invention is generally designated by the reference numeral 160. Door wedge 160 is fabricated from a closed cell dense foam that provides the soft gripping and holding of door 60. Door wedge 160 includes a generally flat bottom surface 162 having first and second ends 164 and 166, respectively, and extending between first and second sides 169 and 171, respectively. Inclined surface 168 extends along a longitudinal axis from second end 166 of bottom surface 162 and diverges from bottom surface 162. Inclined surface 168, first end 164 of bottom surface 162, and first and second sides 169 and 171, respectively, are interconnected by end surface 172.

In operation, it is intended for door wedge 160 to be positioned between lower edge 58 of a conventional door 60 and supporting surface 62. Door wedge 160 is slid axially beneath door 60 such that inclined surface 168 of door wedge 160 engages lower edge 58 of door 60. In order to retain door 60 on door wedge 160, door 60 may be further pivoted onto inclined surface 168 such that the force of lower edge 48 of door 60 compresses inclined surface 168.

Figure 12:
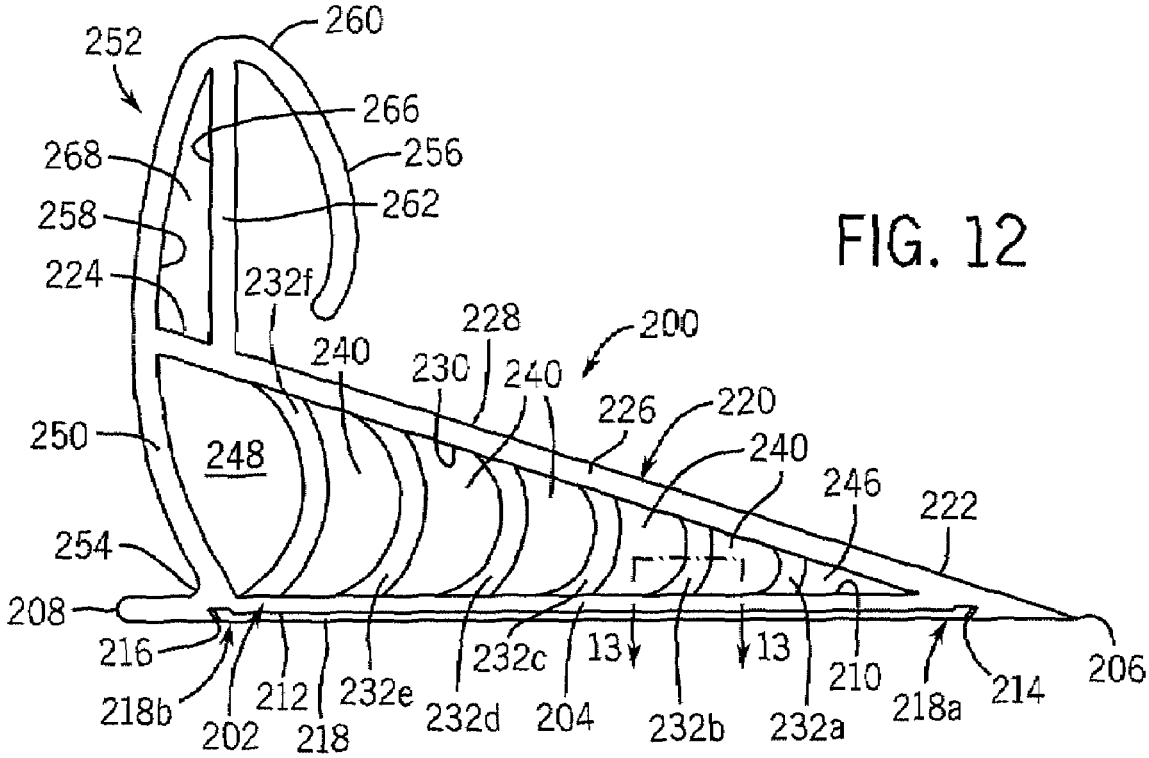
FIG. 12 is an isometric view of the sixth embodiment of a door wedge in accordance with the present invention.
Figure 13:
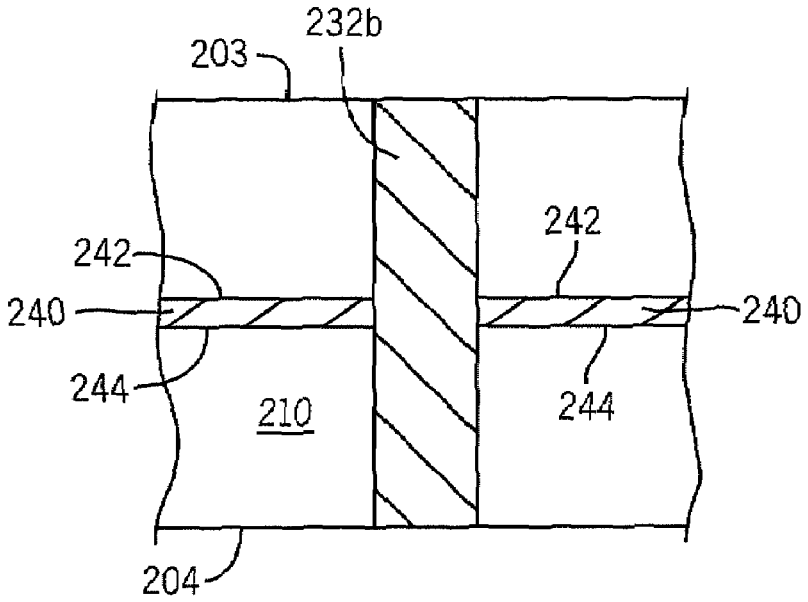
FIG. 13 is a cross-sectional view of the door wedge of the present invention taken along line 13-13 of FIG. 12.

Referring to FIGS. 12-13, an alternate embodiment of a door wedge is generally designated by the reference numeral 200. Door wedge 200 may be fabricated from vinyl or other suitable material. Door wedge 200 includes a generally flat base 202 extending along a longitudinal axis and having first and second sides 203 and 204, respectively, and first and second ends 206 and 208, respectively. Base 202 further includes a generally flat upper surface 210 and a generally flat lower surface 212. A first slot 214 extends between the first and second sides 203 and 204, respectively, of base 202 transverse to the longitudinal axis at a location adjacent and first end 206 thereof. Second slot 216 extends between first and second sides 203 and 204, respectively, of base 202 transverse to the longitudinal axis of base 202 and adjacent second end 208 thereof. It is contemplated for base 202 to be formed from a material having a higher durometer value that the material from which the remaining portions of door wedge 200, hereinafter described. A generally flat skid resistant pad 218 is affixed to lower surface 212 of base 202 between first and second sides 203 and 204, respectively. Pad 218 includes a first end 218*a* received in the first slot 214 and lower surface 212 of base 204 and a second end 218*b* received in second slot 216 in lower surface 212 of base 202.

Door wedge 200 further includes generally inclined plate 220 extending along an axis at a predetermined acute angle to base 202. Inclined plate 220 includes first and second ends 222 and 224, respectively, and first and second sides (not shown) and 226, respectively. Inclined plate 220 is further defined by a generally flat upper surface 228 and a generally flat lower surface 230 directed towards upper surface 210 of base 202. First end 222 of inclined plate 220 is integral with and operatively connected to first end 206 of base 202. In addition, the lower surface 230 of inclined plate 220 is operatively connected to upper surface 210 of base 202 by a plurality of longitudinally spaced C-shaped ribs 232*a*-232*f*. Rib 232*a* is spaced from first end 222 of inclined plate 220 and rib 232*f* is spaced from second end 224 of inclined plate 220. The upper ends of ribs 232*a*-232*f* are integral with and operatively connected to lower surface 230 of inclined plate 220. The lower ends of ribs 232*a*-232*f* are integral with and operatively connected to upper surface 210 of base 202. Ribs 232*a*-232*f* urge inclined plate 220 away from base 202 towards its inclined position, FIG. 12.

It is contemplated to provide webs 240 between adjacent ribs 232*a*-232*f*. As best seen in FIG. 13, each web 240 includes a first surface 242 spaced from first side 203 of base 202 and a second side 244 spaced from second side 204 of base 202. Web 246 extends between rib 232*a* and first ends 206 and 222 of base 202 and inclined plate 220, respectively. Web 248 extends between rib 232*f* and lower portion 250 of hook element 252.

Hook element 252 of door wedge 200 has a first lower end 254 integral with and operatively connected to base 202 and at a location adjacent second end 208 thereof and a second hooked end 256. Second end 224 of inclined plate 220 intersects and is operatively connected to inner surface 258 of hook element 252 at a location between lower end 254 and hooked end 256 of hook element 252. Lower portion 250 of hook element 252 also urges inclined plate 220 away from base 202 towards its inclined position, FIG. 12. Hooked end 256 of hook element 252 folds back onto to itself such that at least a portion of outer surface 260 of hooked end 256 is directed towards first end 222 of inclined plate 220. It is noted that hooked end 256 of hook element 252 acts as a stop and a spring, as hereinafter described. Inner surface 258 of hook element 252 is operatively connected upper surface 228 of inclined plate 220 by a vertical rib 262. Vertical rib 262 adds strength and stability to hook portion 256 of hook element 252. It is contemplated to also connect surface 266 of vertical rib 262 to inner surface 258 of hook element 252 with web 268.

In operation, it is intended for door wedge 220 to be positioned between lower edge 58 of the connection of door 60 and a supporting surface such as floor 62 or the like. Door wedge 200 is slid axially beneath door 50 such that upper surface 228 of inclined plate 220 engages lower edge 58 of door 60. In order to retain door 60 on door wedge 200, door 60 may be further pivoted onto upper surface 228 of inclined plate 220 towards second end 224 thereof. Under the compressive force of lower edge 48 of door 60, inclined plate 220 is urged downwardly toward upper surface 210 of base 202. Ribs 232*a*-232*f* and lower portion 250 of hook element 252 act as springs to urge inclined plate 220 upwardly to snuggly retain door wedge 200 against lower edge 58 of door 60 thereby retaining door 60 at a user desired position. Pad 212 prevents door wedge 200 from moving along supporting surface 62 as door 60 is positioned thereon. In addition, hooked end 256 of hook element 252 limits the position of door 60 on door wedge 200 by urging door 260 away from second end 224 of inclined plate 220.

Hooked end 256 of hook element 252 of door wedge 200 allows door wedge 200 to be operatively connected to various items for storage and/or transport. By way of example, hooked end 256 of hook element 252 of door wedge 200 may be mounted on handle 64 of a conventional broom 66, FIG. 3; on rim 68 of a conventional bucket 70, FIG. 4; an outer edge 72 of a conventional cart 74, FIG. 5; and/or on belt 76 worn by an individual 78, FIG. 6.

Various modes of carrying out the invention are contemplated as being within the scope of the following claims particularly pointing out and distinctly claiming the subject matter which is regarded as the invention.

We claim:

1. A door wedge for maintaining a door at a user desired position, the door pivotable over a supporting surface between an open position and a closed position, comprising:

a body extending along a longitudinal axis and having a resilient inclined surface for engaging a bottom surface of the door and a lower surface at an acute angle to the inclined surface, the body including:

an inclined plate having a lower surface and an upper surface defining the inclined surface of the body; and a base having an upper surface and a lower surface defining the lower surface of the body;

a plurality of generally arcuate ribs having upper ends in engagement with the lower surface of the inclined plate and lower ends in engagement with the upper surface of the base;

a hook projecting from the inclined surface of the body; and a pad affixed to the lower surface of the body for discouraging movement of the body over the supporting surface;

wherein the plurality of generally arcuate ribs act to urge the inclined plate against the bottom surface of the door thereby retaining the door at a user desired position.

2. The door wedge of claim 1 wherein body is fabricated from a vinyl material.

3. The door wedge of claim 1 wherein the arcuate ribs are generally C-shaped.

4. The door wedge of claim 1 wherein:

the inclined plate has first and second ends;

the base has first and second ends; and the first end of the base intersects the first end of the inclined plate.

5. The door wedge of claim 4 further comprising an end wall having a first end interconnected to the second end of inclined plate and a second end operatively connected to the upper surface of the base.

6. The door wedge of claim 4 wherein the hook is positioned between the first and second ends of the inclined plate and includes a terminal end vertically spaced from the upper surface of the inclined plate.

7. The door wedge of claim 1 wherein:

the lower surface of the body includes first and second spaces slots transverse to the longitudinal axis; and the pad includes a first end received in the first slot in the lower surface of the body and a second end received in the second slot in the lower surface of the body.

8. A door wedge for maintaining a door at a user desired position, the door pivotable over a supporting surface between an open position and a closed position, comprising:

a base extending along a first axis and having upper and lower surfaces and first and second ends;

an inclined plate extending along a second axis at a predetermined angle to the first axis and having upper and lower surfaces and first and second ends, the first end of the inclined plate intersecting the first end of the base;

a plurality of generally arcuate ribs having upper ends in engagement with the lower surface of the inclined plate and lower ends in engagement with the upper surface of the base;

a hook projecting from the inclined plate, the hook having a terminal end vertically spaced from the upper surface of the inclined plate; and a pad affixed to the lower surface of the base;

wherein the plurality of generally arcuate ribs act to urge the inclined plate against the door thereby retaining the door at a user desired position.

9. The door wedge of claim 8 wherein the arcuate ribs are generally C-shaped.

10. The door wedge of claim 8 further comprising an end wall having a first end interconnected to the second end of inclined plate and a second end operatively connected to the upper surface of the base.

11. The door wedge of claim 8 wherein the hook includes an central portion overlapping the upper surface of the inclined plate.

12. The door wedge of claim 8 wherein:

the lower surface of the base includes first and second spaces slots transverse to the longitudinal axis; and the pad includes a first end received in the first slot in the lower surface of the base and a second end received in the second slot in the lower surface of the base.

13. A door wedge for maintaining a door at a user desired position, the door pivotable over a supporting surface between an open position and a closed position, comprising:

a base extending along a first axis and having first and second ends the base having an upper surface and a lower surface;

an inclined plate extending along a second axis at a predetermined angle to the first axis, having first and second ends, and having a lower surface and an upper surface engageable with a bottom surface of the door, the first end of the inclined plate intersecting the first end of the base;

a plurality of generally arcuate ribs having upper ends in engagement with the lower surface of the inclined plate and lower ends in engagement with the upper surface of the base; and a hook projecting from the inclined plate, the hook having a terminal end vertically spaced from the inclined plate;

wherein the plurality of generally arcuate ribs act to urge the inclined plate against the bottom surface of the door thereby retaining the door at a user desired position.

14. The door wedge of claim 13 wherein the arcuate ribs are generally C-shaped.

15. The door wedge of claim 13 wherein:

the lower surface of the base includes first and second spaces slots transverse to the longitudinal axis; and the pad includes a first end received in the first slot in the lower surface of the base and a second end received in the second slot in the lower surface of the base.

16. The door wedge of claim 13 further comprising an end wall having a first end interconnected to the second end of inclined plate and a second end operatively connected to the upper surface of the base.

* * * * *